US005718638A

United States Patent [19]

Kameda

[11] Patent Number: 5,718,638

[45] Date of Patent: Feb. 17, 1998

[54] AUTOMATIC GOLF BALL TEEING UP DEVICE

[75] Inventor: Tuyoshi Kameda, Konosu, Japan

[73] Assignee: Kansei Corporation, Omiya, Japan

[21] Appl. No.: 679,127

[22] Filed: Jul. 12, 1996

[30] Foreign Application Priority Data

Jul. 13, 1995 [JP] Japan ..... 7-177519

[51] Int. Cl.[6] ..... A63B 57/00

[52] U.S. Cl. ..... 473/134; 473/136

[58] Field of Search ..... 473/132, 133, 473/134, 135, 136, 137

[56] References Cited

U.S. PATENT DOCUMENTS

| | | | |
|---|---|---|---|
| 2,335,280 | 11/1943 | Hogeberg | 473/136 |
| 5,297,797 | 3/1994 | Lamontagne | 473/133 |
| 5,348,305 | 9/1994 | Lowe | 473/133 |
| 5,549,299 | 8/1996 | Brown | 473/133 |

FOREIGN PATENT DOCUMENTS

| | | |
|---|---|---|
| 61-63264 | 4/1986 | Japan . |
| 4-317673 | 4/1991 | Japan . |
| 5-46831 | 7/1993 | Japan . |
| 6-71005 | 3/1994 | Japan . |
| 6-31776 | 4/1994 | Japan . |
| 6-178836 | 6/1994 | Japan . |
| 6198011 | 7/1994 | Japan . |

*Primary Examiner*—Steven B. Wong
*Attorney, Agent, or Firm*—Foley & Lardner

[57] ABSTRACT

An automatic golf ball teeing up device has an upper plate formed with a ball passing opening. A ball receiving box is positioned just below the ball passing opening. Golf balls are fed into the ball receiving box one after another. A ball push-up mechanism is employed, which includes a ball push-up member movable in parallel with a major surface of the upper plate into the box to push up the ball in the box to a given upper position, and a tee member movable with the ball push-up member and puts thereon the ball when coming into the box just below the ball-passing opening. A lift mechanism is further employed for lifting up the tee member together with the ball to a predetermined height through the ball-passing opening when the action for putting the ball onto the tee member is completed in the box. A drive mechanism is employed for actuating the ball push-up mechanism and the lift mechanism in order.

18 Claims, 11 Drawing Sheets

AUTOMATIC GOLF BALL TEEING UP DEVICE

BACKGROUND OF THE INVENTION

1. Field of the Invention

The present invention relates in general to training tools for golf, and more particularly to automatic golf ball teeing up devices that automatically put golf balls onto a tee member one after another in time to the club swings of a golf trainee.

2. Description Of the Prior Art

Various automatic ball teeing up devices have been proposed and put into practical use. These devices are usually equipped in a golf training place for relieving golf trainees from troublesome manual ball teeing up actions. Some of these devices are disclosed in Japanese Utility Model First Provisional Publications 61-63264 & 6-31776, Japanese Patent Second Provisional Publication 5-46831 and Japanese Patent First Provisional Publication 6-198011.

The automatic devices of these publications are of a type in which a vertically movable tee member is employed. In a rest condition, the tee member assumes a lower position, and once a golf ball is conveyed to a given position just above the tee member, the tee member is lifted up to an upper position putting thereon the ball. When the ball is hit and thus removed, the tee member is moved down to the lower position to stand by for a subsequent ball teeing up action.

However, due to inherent construction, these prior art automatic ball teeing up devices have a bulky construction. Particularly, due to employment of a lifting mechanism by which the tee member is greatly lifted, the devices are compelled to have a housing or case whose height or thickness is great. As known, when the devices have such a great thickness, it becomes necessary to dig deeper holes in the ground for setting them therein.

In order to solve the above-mentioned drawback, so-called low-height type ball teeing up devices have been proposed, which are shown for example in Japanese Patent First Provisional Publications 4-317673, 6-71005 and 6-178836. However, even these devices have failed to have a satisfactorily reduced thickness.

SUMMARY OF THE INVENTION

It is therefore an object of the present invention to provide an automatic golf ball teeing up device having a satisfactorily reduced thickness.

According to the present invention, there is provided an automatic golf ball teeing up device that can easily control the vertical position of a golf ball on a tee member.

According to the present invention, there is further provided an automatic golf ball teeing up device that can exhibit a sufficient resistance against a big shock applied when the ball on the tee member is hit.

According to the present invention, there is still further provided an automatic golf ball teeing up device that can be mounted to the ground with easy assembling work.

According to one aspect of present invention, there is provided an automatic golf ball teeing up device which comprising an upper plate having a ball passing opening formed therethrough; a ball receiving box located just below the ball passing opening; means for feeding golf balls into the ball receiving box one after another; a ball push-up mechanism including a ball push-up member movable in parallel with a major surface of the upper plate into the box to push up the ball in the box to a given upper position, and a tee member movable with the ball push-up member and puts thereon the ball when coming into the box just below the ball passing opening; a lift mechanism for lifting up the tee member together with the ball to a predetermined high position through the ball passing opening when the action for putting the ball onto the tee member is completed in the box; and a drive mechanism for actuating the ball push-up mechanism and the lift mechanism in order.

According to another aspect of the present invention, there is provided an automatic golf ball teeing up device comprising an upper plate having a ball passing opening formed therethrough; a ball receiving box located just below the ball passing opening; first means for feeding golf balls into the ball receiving box one after another; a ball push-up member movable in parallel with a major surface of the upper plate, the ball push-up member pushing up the ball in the box to a given upper position when moving into the box; a tee member movable with the ball push-up member, the tee member being capable of putting thereon the ball when coming into the box just below the ball passing opening; a lifting mechanism for lifting up the tee member together with the ball to a predetermined high position through the ball passing opening when the action for putting the ball onto the tee member is completed; and second means for causing the lifting mechanism to lower the tee member to the interior of the box when the ball on tee member is removed.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Referring to FIGS. 1 to 7 of the drawings, particularly FIGS. 1 to 4, there is shown an automatic golf ball teeing up device according to the present invention.

Figure 2A:
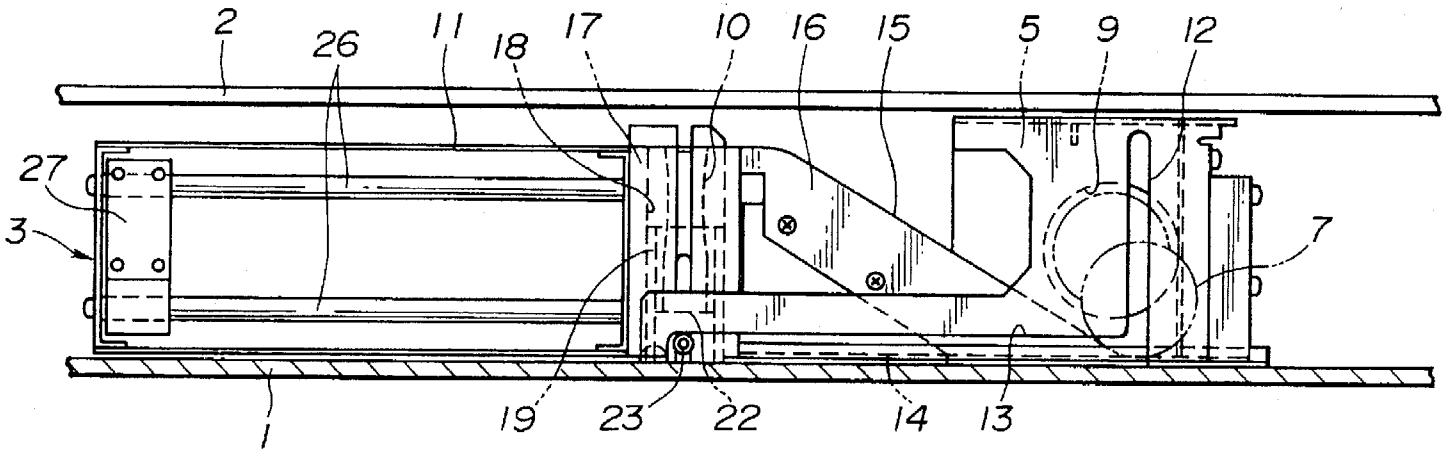
FIG. 2A is a side view taken along the line IIA—IIA of FIG. 1.
Figure 2B:
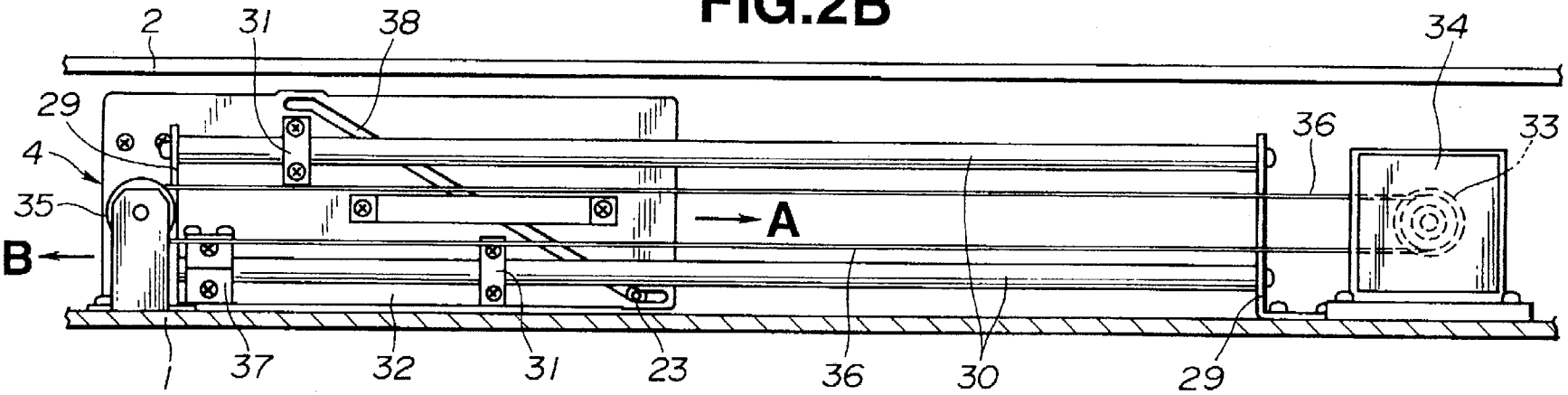
FIG. 2B is a side view taken along the line IIB—IIB of FIG. 1.
Figure 3:
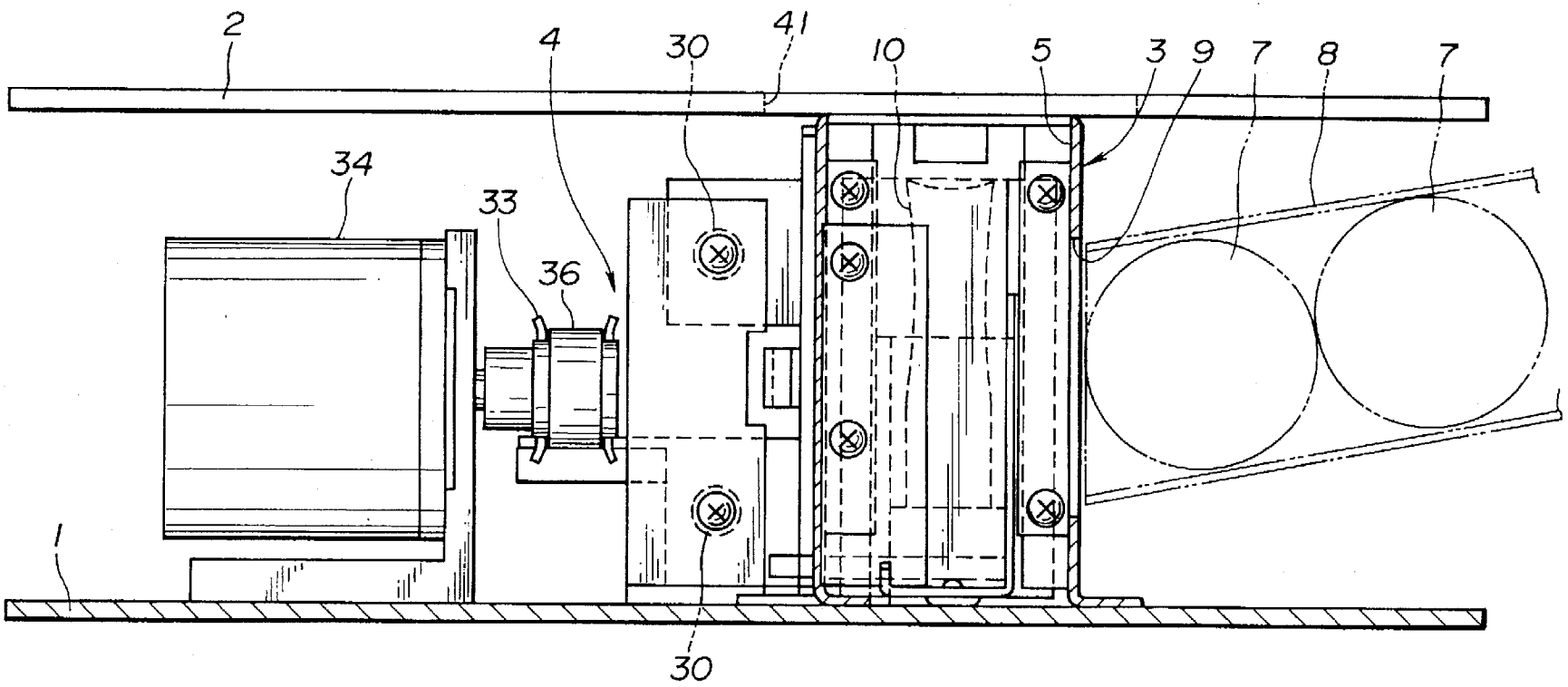
FIG. 3 is a side view of the device, taken from a right side of FIG. 1.

In FIGS. 2A to 4, particularly FIG. 3, denoted by numerals 1 and 2 are a base plate and an upper plate constituting part of a rectangular flat housing. The upper plate 2 is formed with a larger circular opening 41.

Within the flat housing, there are installed a teeing up mechanism 3 and a drive mechanism 4 for driving the teeing up mechanism 3.

As seen from FIGS. 1 and 3, the teeing up mechanism 3 comprises a ball receiving box 5 in rectangular parallelepiped shape, which is positioned just below the circular opening 41 of the upper plate 2 and tightly disposed on the base plate 1 through bolts 6.

Figure 1:
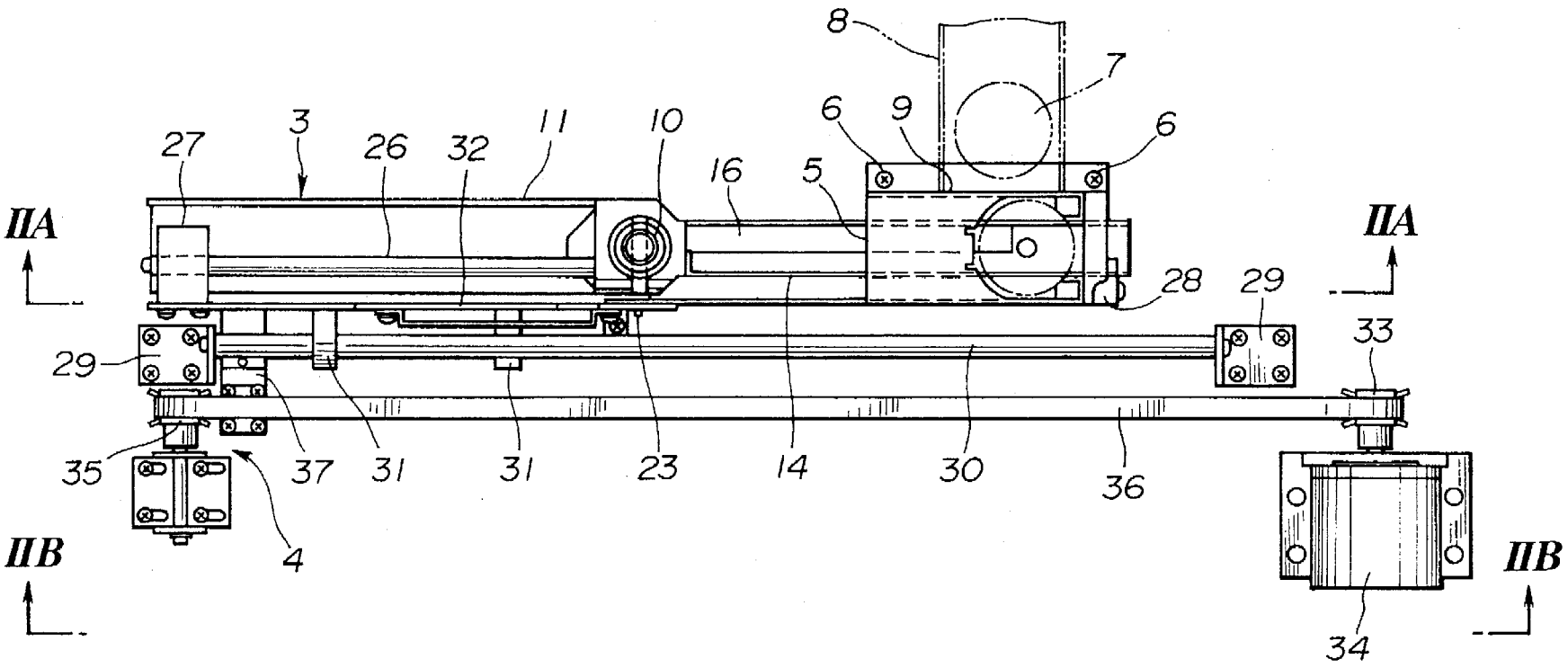
FIG. 1 is a plan view of an automatic golf ball teeing up device according to the present invention.

As understood from FIG. 1, the ball receiving box 5 has upper, right and left walls opened, as viewed. As will become apparent as the description proceeds, the upper opening is an opening through which a golf ball 7 is pushed up, and the right and left openings are openings through which a ball push-up member 16 (see FIG. 2A) reciprocatively passes. As understood from FIG. 3, the upper opening of the ball receiving box 5 is positioned just below the larger circular opening 41 of the upper plate 2.

As seen from FIG. 1, the ball receiving box 5 has a rear wall formed with a ball inlet opening 9. The ball inlet opening 9 is better shown in FIG. 3 which, is a view taken from a right side of FIG. 1. A ball guide tube 8 extends to the ball inlet opening 9 from a ball collecting basket (not shown). For conveying the balls 7 by practially using their own weight, the tube 8 is inclined as shown. The interior of the ball receiving box 5 is formed with a guide structure by which the ball 7 in the box 5 can be smoothly guided under upward movement toward the upper opening.

As seen from FIG. 2A, the ball push-up member 16 is connected to a horizontally moving frame 11 to move therewith. A hollow tee member 10 of rubber material is fixed to a front end of the frame 11. The tee member 10 is about 62 mm in length.

As will become apparent hereinafter, a unit (16, 11 and 10) including the ball push-up member 16, the frame 11, and the tee member 10 can horizontally move into the interior of the ball receiving box 5 through the left opening of the box 5.

As seen from FIG. 2A, a front wall of the ball receiving box 5 is formed with an L-shaped slit (12, 13), which includes a vertical part 12 and a horizontal part 13 extending leftward from a lower end of the vertical part 12. This slit is used for guiding a pin 23.

As seen from FIGS. 2A and 1, an elongate slide plate 14 extends horizontally rightward from the front lower end of the moving frame 11. The slide plate 14 extends rightward while passing through the interior of the ball receiving box 5. For assuring horizontal and straight movement of the slide plate 14, a guide member 28 (see FIG. 1) is incorporated with the slide plate 14.

On the slide plate 14, there is tightly mounted the ball push-up member 16 formed with an inclined upper surface 15. That is, as shown in FIG. 2A, the upper surface 15 is inclined so that the height gradually increases with increase of distance from the right end. A pointed leading end of the ball push-up member 16 is directed toward the ball receiving box 5, as shown.

Designated by numeral 17 in FIG. 2A is an outer cylinder disposed between the moving frame 11 and the ball push-up member 16. The outer cylinder 17 has a vertically extending bore 18. Within the bore 18, there is slidably disposed an inner cylinder 19.

Figure 4:
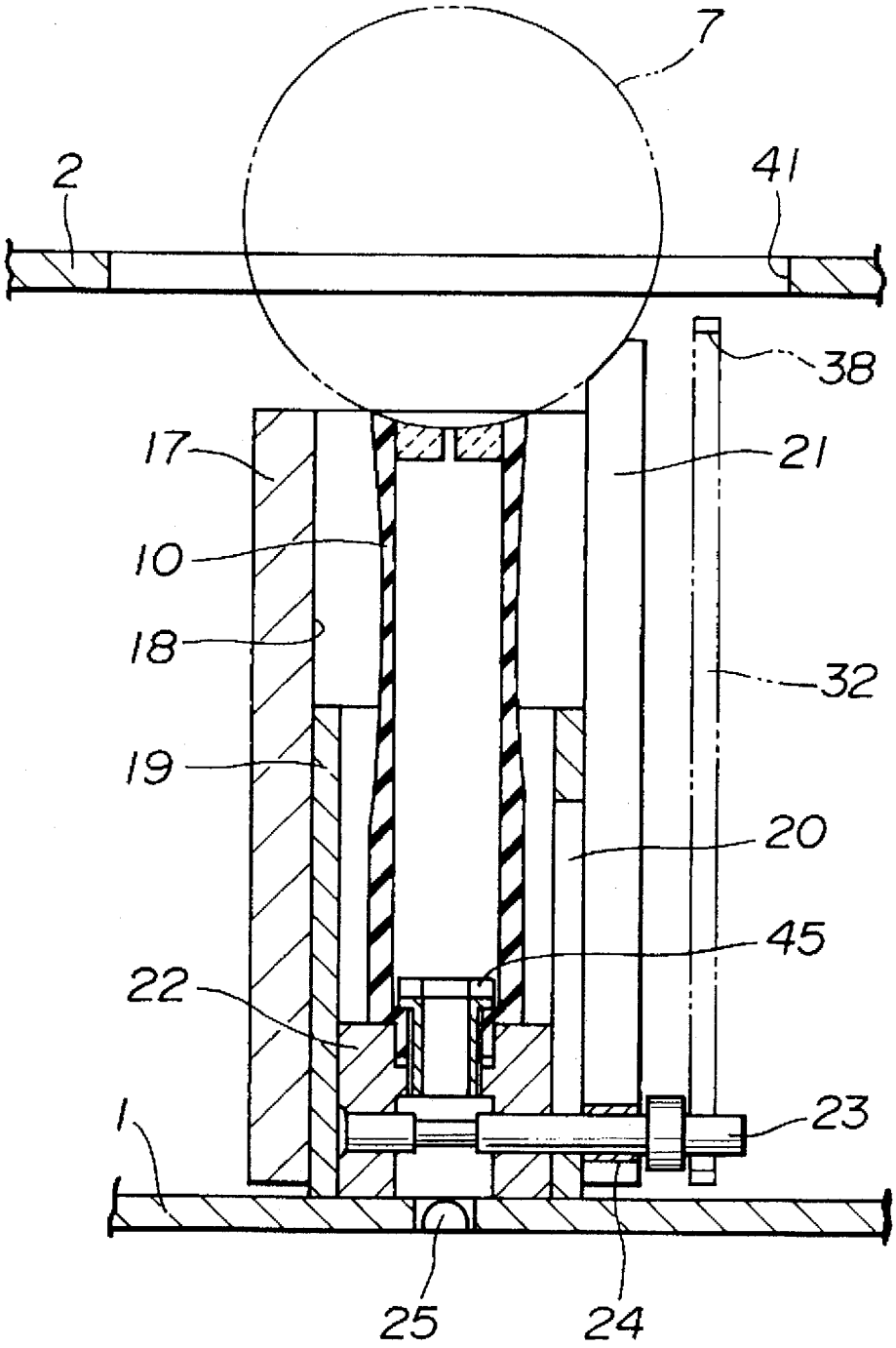
FIG. 4 is a sectional view of an interior portion of the device taken from a left side of FIG. 1.
Figure 5:
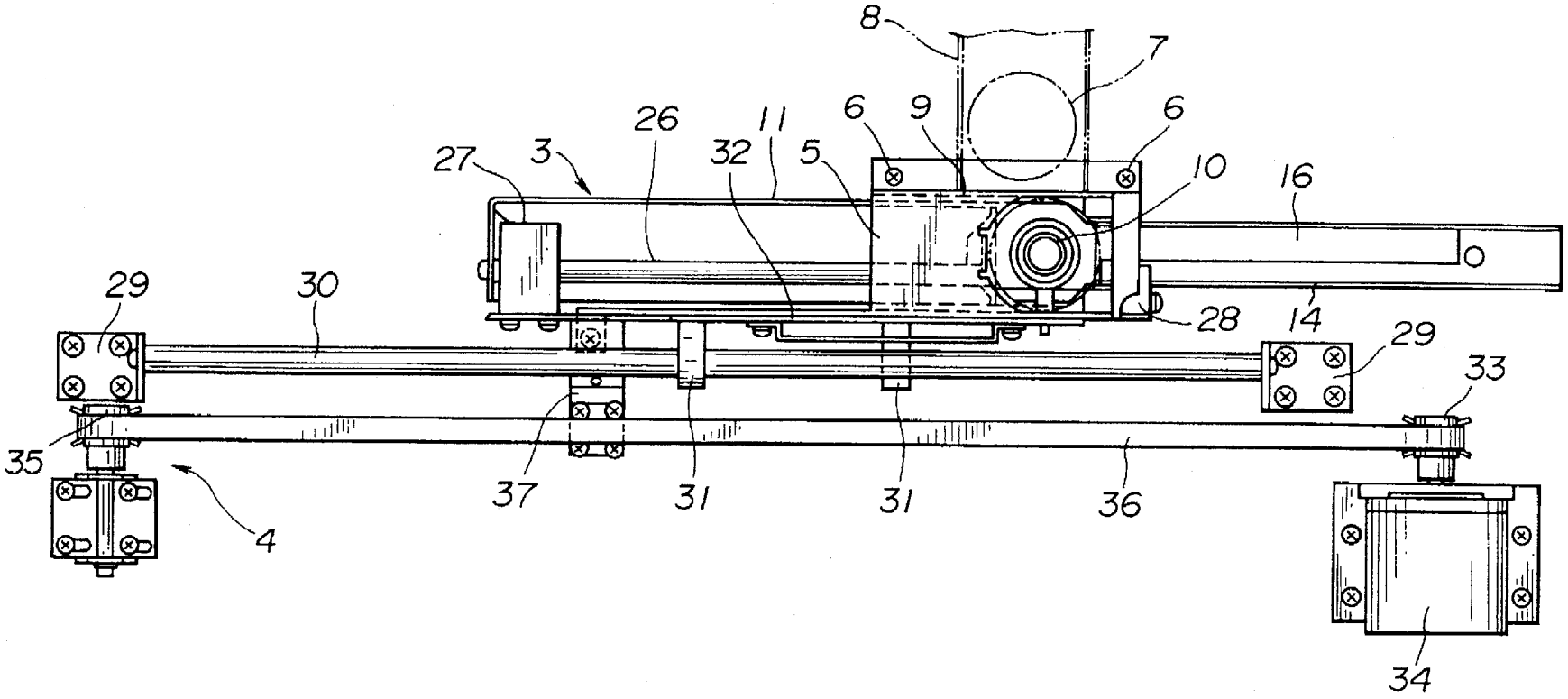
FIG. 5 is a view similar to FIG. 1, but showing a different condition.

As seen from FIG. 4, the outer cylinder 17 is formed at one side wall thereof with a vertically extending slot 21, and the inner cylinder 19 is also formed at one side wall thereof with a vertically extending slot 20, that mates with the slot 21 of the outer cylinder 17. As shown in the drawing, the side wall of the outer cylinder 17, where the elongate slot 21 is formed, is shaped higher than the remaining side wall. As will become apparent hereinafter, the pin 23 moves in and along the mated slots 20 and 21.

As seen from FIG. 4, within the inner cylinder 19, there is slidably received a piston 22 to which the tee member 10 is tightly mounted through a hollow bolt 45.

The pin 23 is fixed to the piston 22 and projected to the outside of the outer cylinder 17 through the slot 20 of the inner cylinder 19 and the slot 21 of the outer cylinder 17. The pin 23 is equipped with a bearing 24 for smoothing the movement in the slot 21. A ball sensor 25 is mounted on the base plate 1 at a position coaxial with the tee member 10 for sensing whether a ball 7 is present on the tee member 10 or not. A photocell type sensor may be used.

Referring back to FIG. 2A, within the moving frame 11, there extend two parallel guide rails 26 by which a slider 27 is slidably supported.

As seen from FIGS. 1 and 2B, the drive mechanism 4 comprises upper and lower parallel guide rods 30 supported by two brackets 29 secured to the base plate 1. A moving plate 32 moves horizontally while being guided by the guide rods 30 through respective sliders 31. As seen from FIG. 2B, the moving plate 32 has a major flat surface, that is perpendicular to a major surface of the base plate 1.

As seen from FIG. 1, the moving plate 32 has a connecting plate 37 projecting laterally outwardly. The connecting plate 37 is connected to an endless drive belt 36, which is operatively put around a drive pulley 33 and a driven pulley 35. The drive pulley 33 is connected to an output shaft of a step motor 34, while the driven pulley 35 is freely supported on a supporting bracket (no numeral).

As seen from FIG. 2B, the step motor 34 and the supporting bracket are mounted on spaced portions of the base plate 1. Thus, when the step motor 34 is energized to run in one or the other direction, the drive belt 36 is forced to run in one or the other direction, so that the moving plate 32 runs in the direction of the arrow "A" or the other arrow "B" in FIG. 2B along the guide rods 30.

If desired, in place of the driving mechanism including the drive belt 36 and the drive and driven pulleys 33 and 35, other driving mechanisms may be employed, which are, for example, a reciprocating mechanism including a crank shaft and a connecting rod and the like. Of course, a linear motor and an air cylinder may be used as a power source.

As seen from FIG. 2B, the moving plate 32 is formed with a diagonal slot 38 that is inclined so that the height gradually increases with increase of distance from the right end. The diagonal slot 38 slidably receives therein a leading end portion of the pin 23.

Although not shown in the drawings, a control circuit and an electric power source are connected to the step motor 34.

In the following, operation of the golf ball teeing up device of the invention will be described with reference to the drawings.

For ease of understanding, the description will be commenced with respect to a rest condition of the device and a ball 7 is received in the ball receiving box 5, which is shown in FIGS. 1, 2A, 2B and 3.

In the rest condition, as seen in FIGS. 1 and 2B, the connecting plate 37 assumes its leftmost position placing the pin 23 at the lowermost right position of the diagonal slot 38 of the moving plate 32. That is, in the rest condition, the moving frame 11 assumes its leftmost position placing the pointed leading end of the ball push-up member 16 in the ball receiving box 5 just beside the ball inlet opening 9, as shown in FIG. 2A.

When, upon operation of the control circuit, the step motor 34 is energized to run in a normal direction to move, through the drive belt 36 (see FIG. 2B), the moving plate 32 in the direction of the arrow "A", the moving plate 32 draws the moving frame 11 through the pin 23. That is, as understood from FIG. 2A, the unit (11, 16 and 10), including the moving frame 11, the ball push-up member 16, and the tee member 10, is moved rightward sliding the pin 23 in and along the horizontal part 13 of the L-shaped slit (12, 13) formed in the front wall of the ball receiving box 5. That is, during this movement, upward movement of the pin 23 is kept suppressed and thus the pin 23 is kept in the lowermost right position of the diagonal slot 38 of the moving plate 32. As the ball push-up member 16 moves right, the pointed leading end of the ball push-up member 16 forces the ball 7 in the box 5 to ride on the inclined upper surface 15, and thus, with the rightward movement of the ball push-up member 16, the ball 7 is gradually lifted in the ball receiving box 5 while running on the inclined upper surface 15.

Figure 6A:
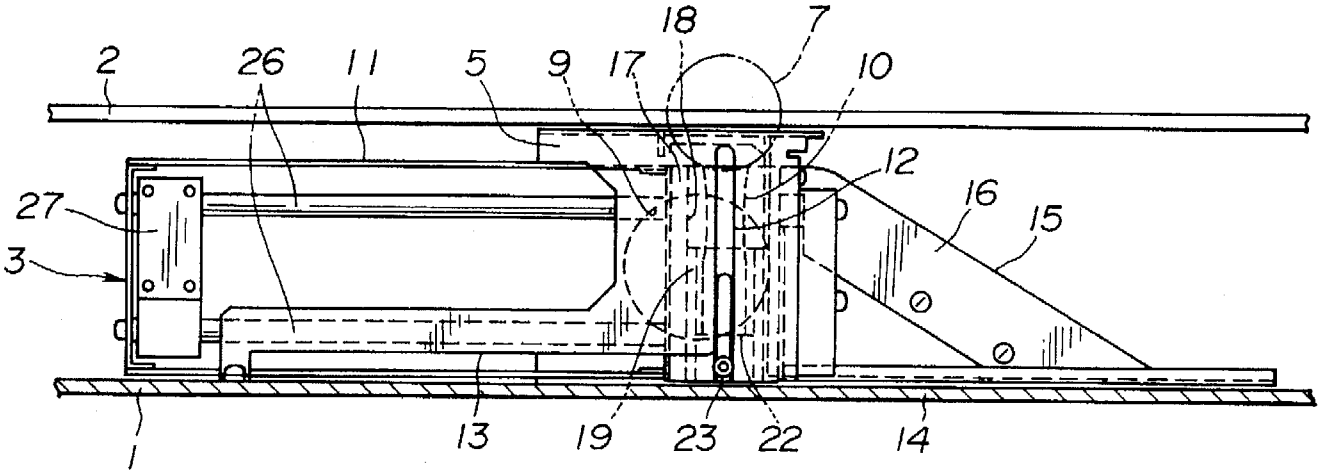
FIG. 6A is a view similar to FIG. 2A, but showing a different condition.
Figure 6B:
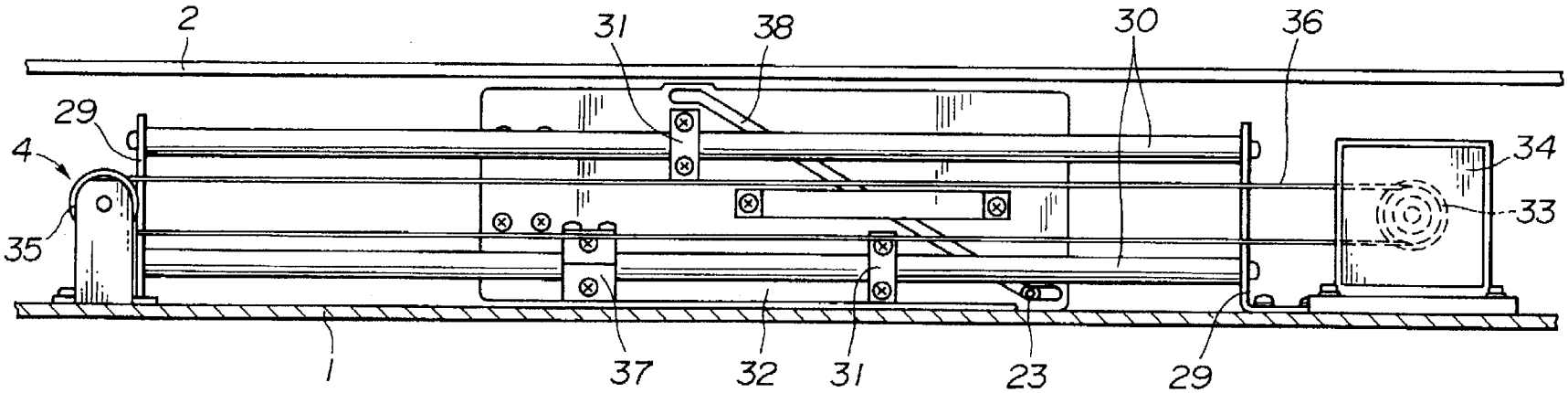
FIG. 6B is a view similar to FIG. 2B, but showing a different condition.

When, as understood from FIG. 6A, the unit (16, 11 and 10) further moves rightward and comes to a position where the tee member 10 is placed in the box 5 and the pin 23 assumes the rightmost position of the horizontal part 13 of the L-shaped slit (12, 13), the ball 7 is led onto the tee member 10 from a highest trailing end of the inclined upper surface 15 as shown in FIG. 6A. These motions are induced by the continuous rightward movement of the moving plate 32 driven by the step motor 34.

When thereafter the moving plate 32 comes to a position where the pin 23 abuts with a vertical wall possessed by the vertical part 12 of the L-shaped slit (12, 13), further rightward movement of the moving plate 32 does not induce a further rightward movement of the unit (11, 16 and 10). However, in this time, further rightward movement of the moving plate 32 allows the pin 23 to run upward in and along the diagonal slot 38 of the plate 32, which causes the pin 23 to move upward in and along the vertical part 12 of the L-shaped slit (12, 13).

With the upward movement of the pin 23, the piston 22 to which the pin 23 is fixed is moved upward in the inner cylinder 19 together with the tee member 10 supporting the ball 7.

When, due to continuous rightward movement of the moving plate 32, the piston 22 is moved up to a position where the pin 23 abuts against an upper end of the vertical slot 20 of the inner cylinder 19, further upward movement of the pin 23 induces an upward movement of the inner cylinder 19 in the outer cylinder 17.

Figure 7:
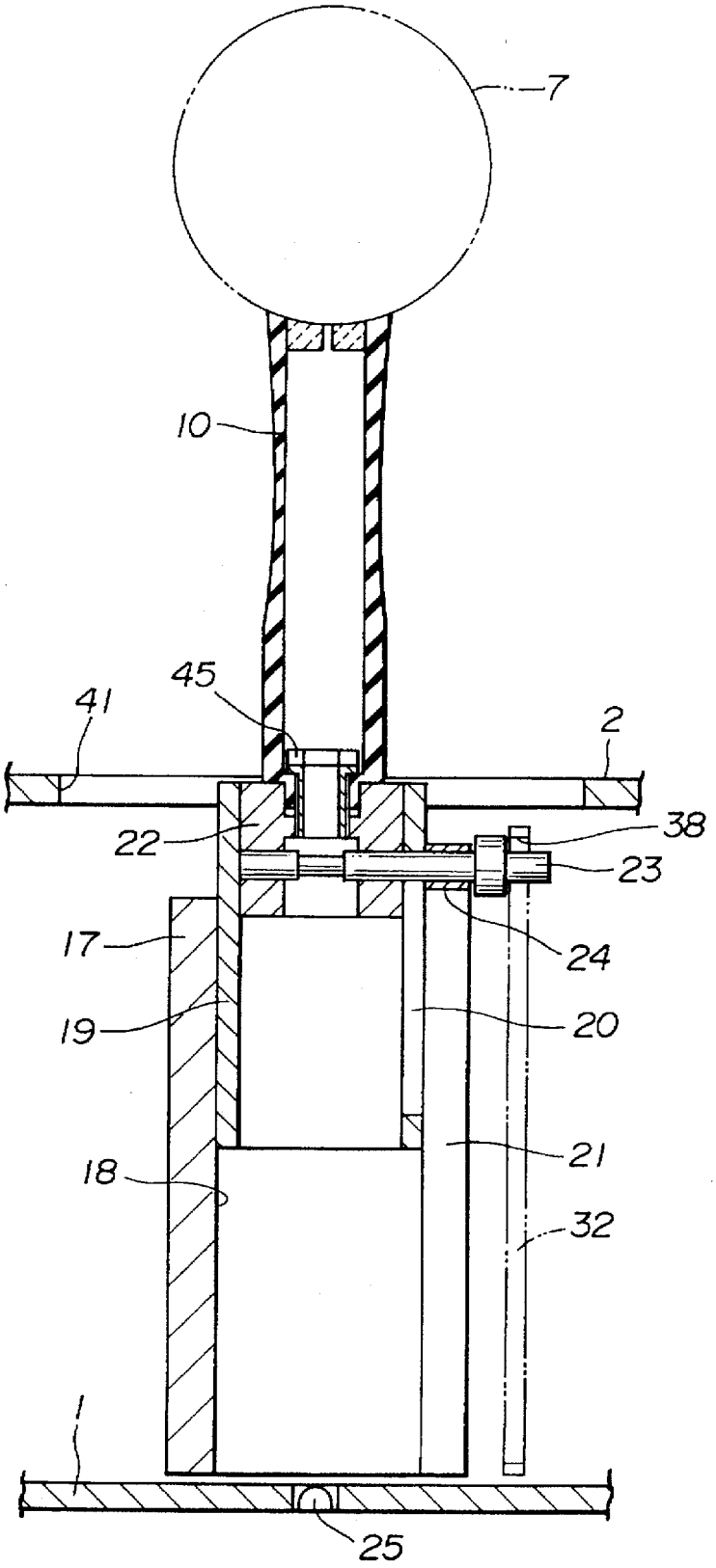
FIG. 7 is a view similar to FIG. 4, but showing a different condition.

As seen from FIG. 7, the upward movement of the inner cylinder 19 stops when the pin 23 comes up to the uppermost left position of the diagonal slot 38 of the moving plate 32. A position sensor (not shown) senses this position and causes the control circuit to deenergize the step motor 34. Under this condition, the tee member 10 supporting the ball 7 is kept projected upward to a sufficient level from the upper plate 2. In this projected condition of the tee member 10, it is important to secure a sufficiently large contact area between the piston 22 and the inner cylinder 19 as well as between the inner cylinder 19 and the outer cylinder 17. This is because of a robust structure of the teeing up device in the projected condition, which is really needed when the ball 7 on the tee member 10 is violently hit by a club head.

When the ball 7 is hit by a club and thus removed away from the tee member 10, the ball sensor 25 judges an absence of the ball 7 by sensing a light coming thereto through the interior of the hollow tee member 10. Upon this, the control circuit energizes the step motor 34 to run in a reversed direction. With this, the moving plate 32 is moved leftward in FIG. 2B, that is, toward the original position. During the time for which the pin 23 slides down in the diagonal slot 38 of the moving plate 32, the unit (11, 16 and 10) is kept stationary while permitting a downward movement of the tee member 10 to the lowermost position (see FIG. 4). That is, during this time, the pin 23 is forced to slide down in the vertical part 12 of the L-shaped slit (12, 13) of the box 5. But, thereafter, the unit (11, 16 and 10) is permitted to move toward the original position with the pin 23 running in the horizontal part 13 of the L-shaped slit (12, 13). When the unit (11, 16 and 10) comes back to the original position (see FIG. 2A), another position sensor (not shown) senses this arrival and causes the control circuit to energize the step motor 34 to run in a normal direction to repeat the same operations as described hereinabove. It is to be noted that once the ball push-up member 16 is left away from the ball receiving box 5, another ball 7 kept in the ball guide tube 8 (see FIG. 3) is led into the box 5 by its own weight.

In the following, modifications of the present invention will be described.

Figure 8:
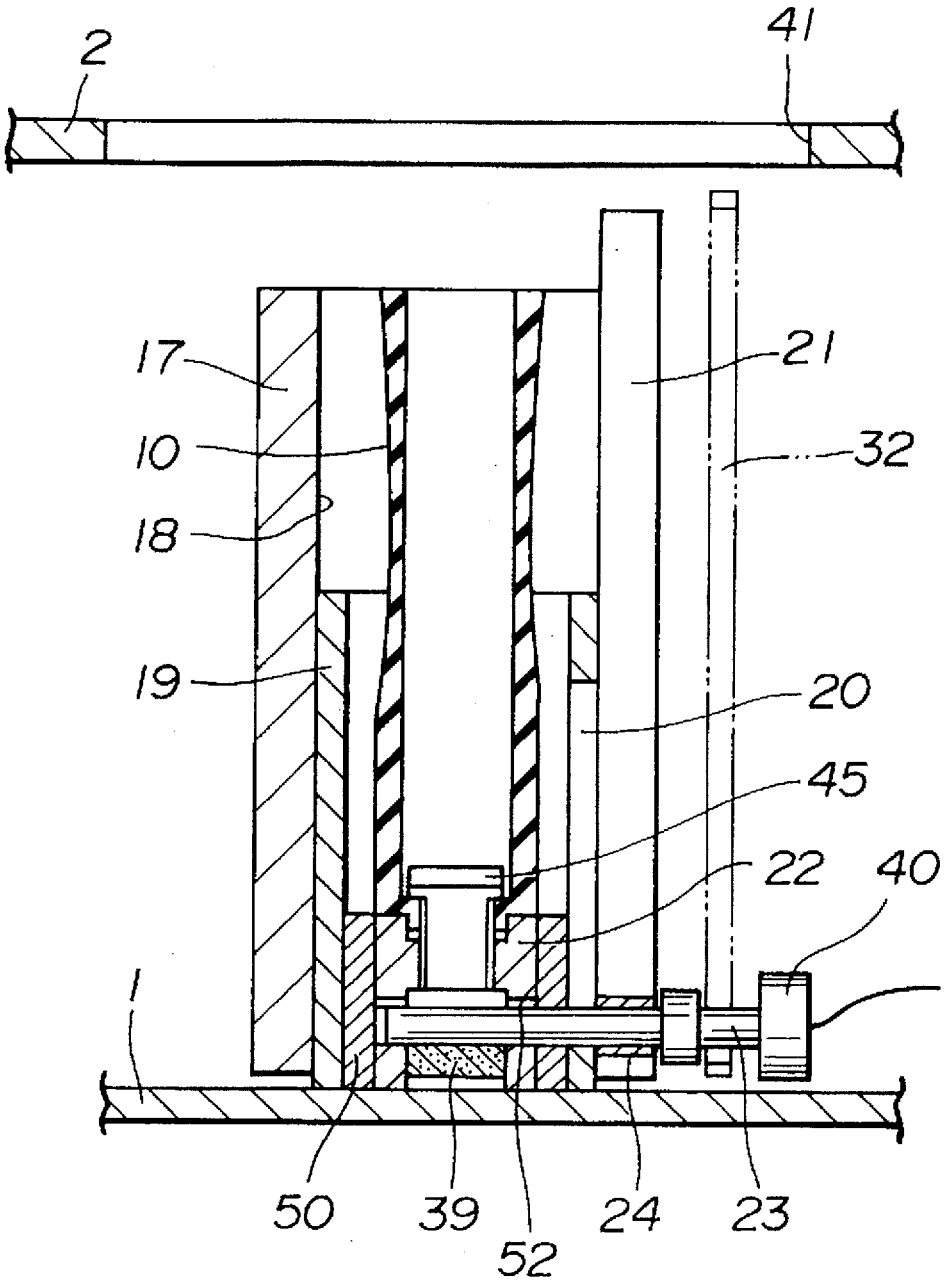
FIG. 8 is a view similar to FIG. 4, but showing a modification of the present invention.
Figure 9:
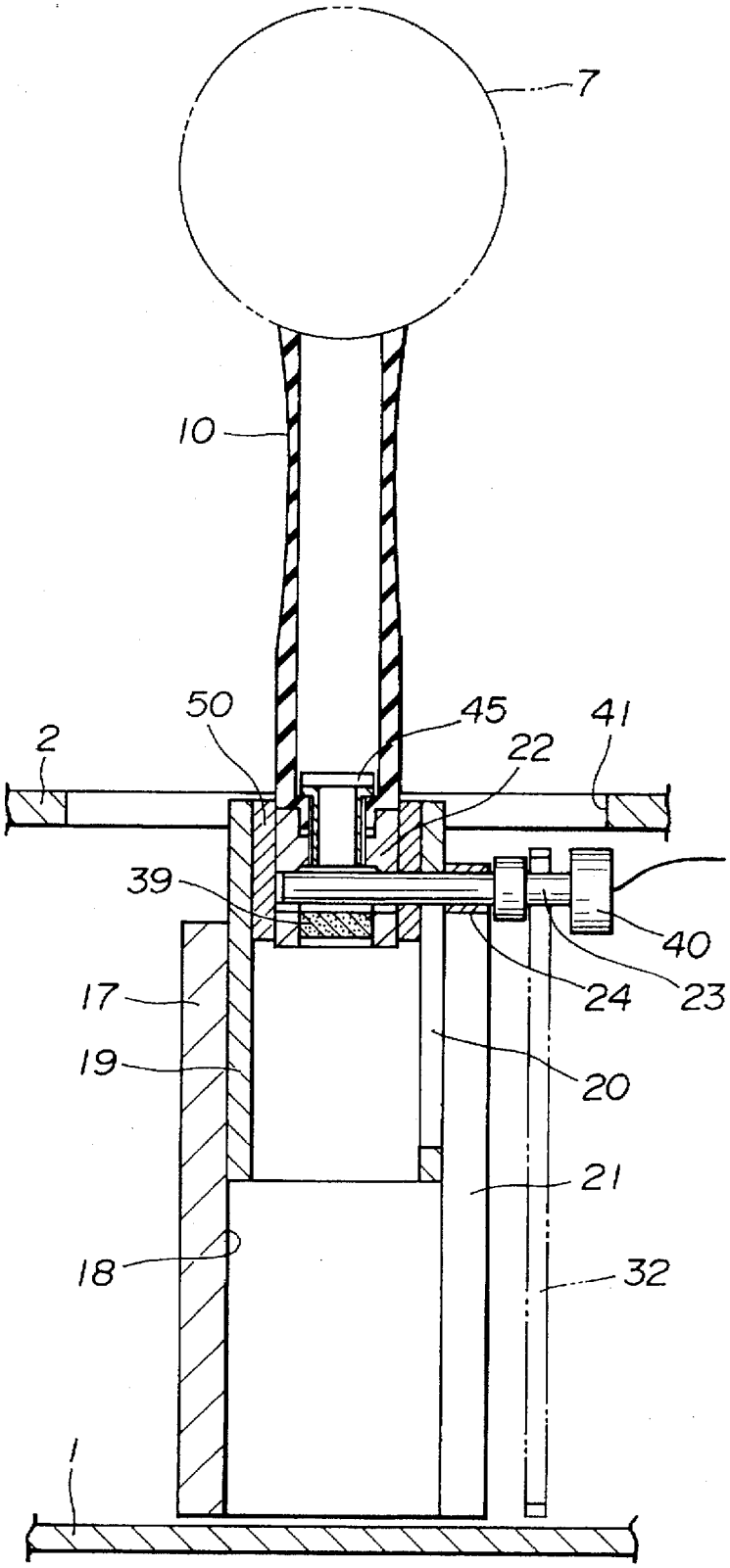
FIG. 9 is a view similar to FIG. 8, but showing a different condition.

In the modification of FIGS. 8 and 9, there is employed a combination of a magnet 39 and an Hall element 40 for sensing whether the ball 7 is present on the tee member 10 or not. In this modification, a sleeve 50 is slidably disposed between the inner cylinder 19 and the piston 22. The pin 23, which is made of a magnetic metal, is secured to sleeve 50 to move therewith and passes through a horizontal slot 52 formed in the piston 22. The horizontal slot 52 is so sized as to permit the pin 23 to move up and down therein. As shown, the magnet 39 is secured to the piston 22 at a position just below the pin 23, while the Hall element 40 is secured to the pin 23.

Thus, if, as shown in FIG. 8, no ball is put on the tee member 10 causing the piston 22 to support only a light weight, the magnet 39 is attracted and attached to the pin 23 against the weight. The Hall element 40 senses a change of the magnetic force through the pin 23 and thus senses that the tee member 10 has no ball put thereon. While, if, as shown in FIG. 9, a ball 7 is put on the tee member 10 causing the piston 22 to support a relatively heavy weight, the magnet 39 is separated from the pin 23 being overcome with the weight. The Hall element 40 senses another change of the magnetic force and thus senses that the tee member 10 has the ball 7 sitting on it.

If desired, a piezoelectric element may be used as the ball sensor. In this case, the element is set beneath a lower end of the tee member 10 or the bolt 45.

Figure 10:
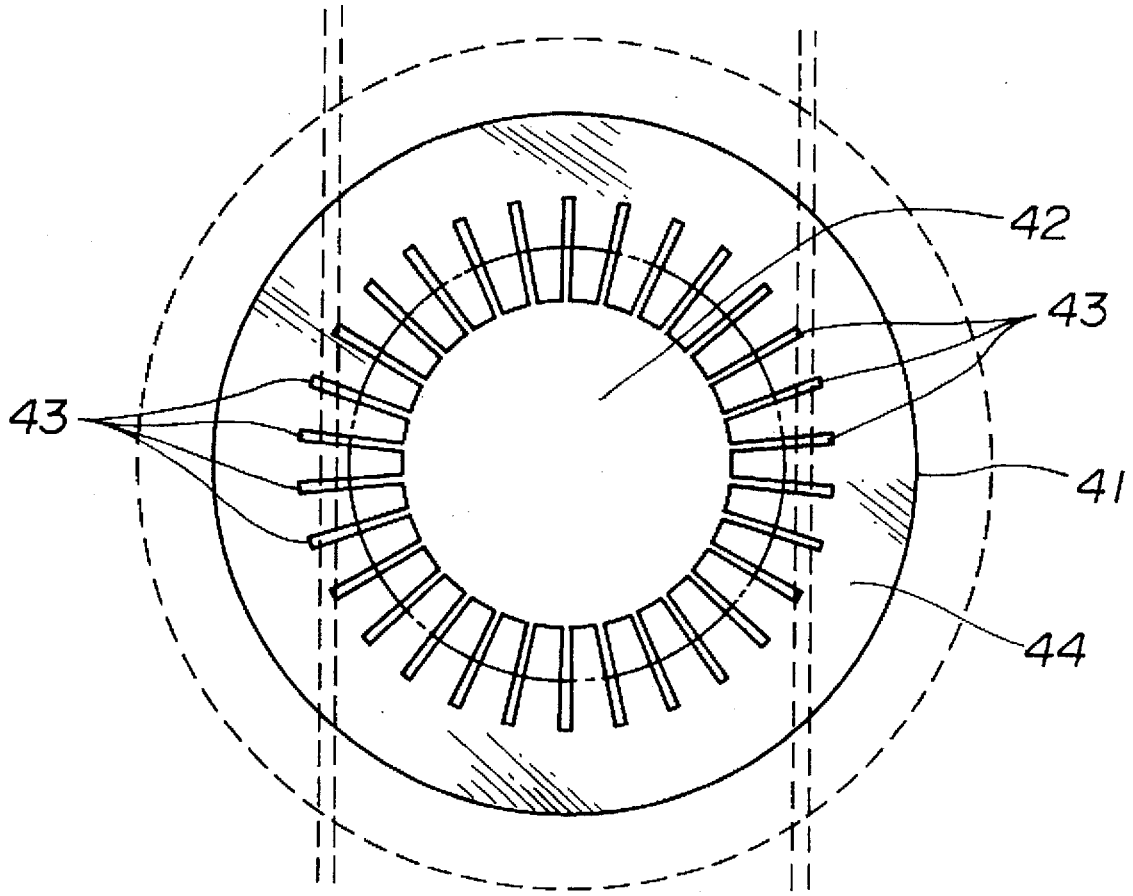
FIG. 10 is a plan view of a ball holding circular sheet employed in the present invention.
Figure 11:
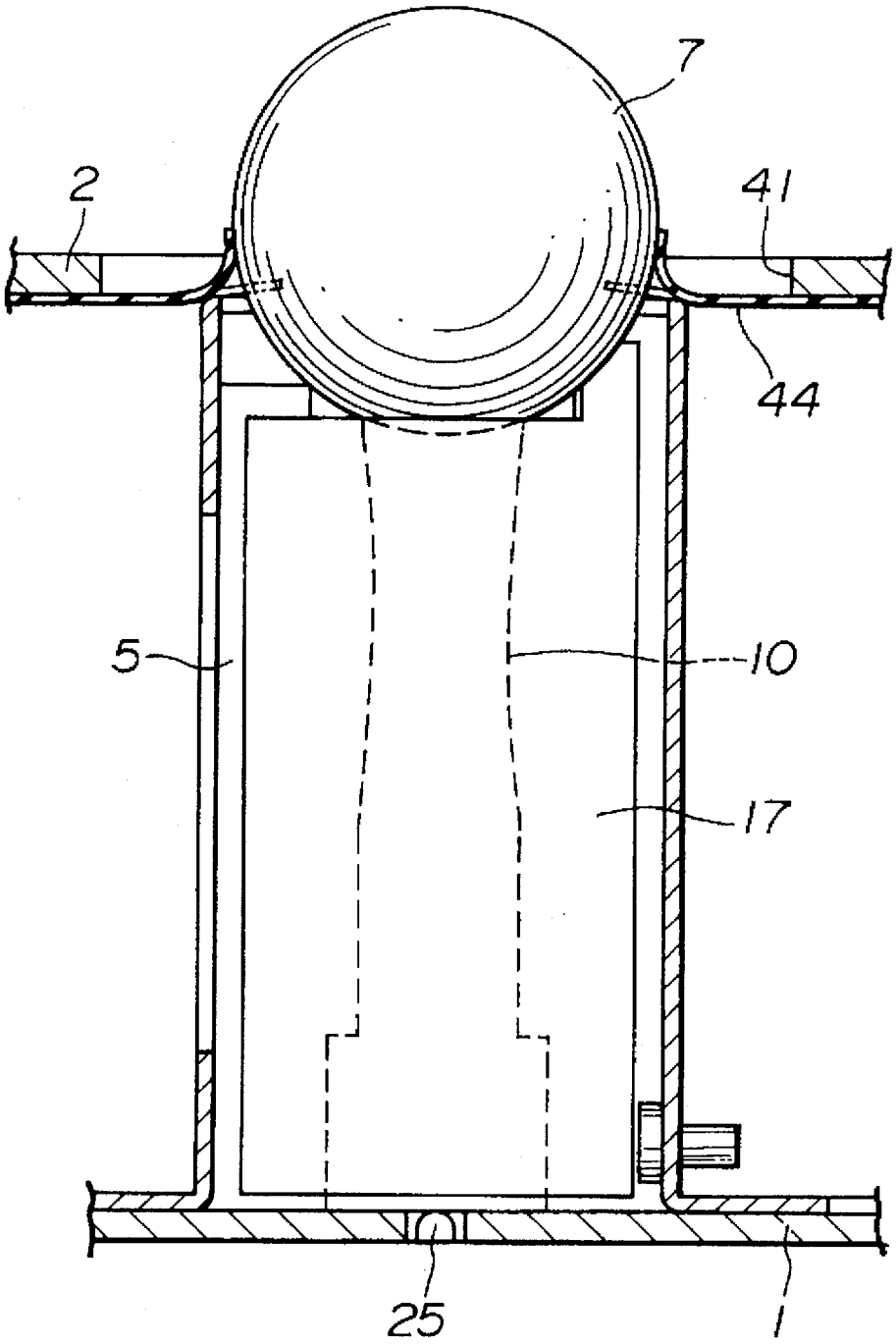
FIG. 11 is a view similar to FIG. 4, but showing a case wherein the ball holding circular sheet of FIG. 10 is employed.

In the modification of FIGS. 10 and 11, there is employed a ball holding circular sheet 44 of a flexible rubber material, which is fixed to the upper plate 2 in a manner to cover the circular opening 41 of the upper plate 2. As seen from FIG. 10, the ball holding sheet 44 is formed with a circular center opening 42 which, is somewhat smaller in diameter than the ball 7, and a plurality of slits 43 extending radially outwardly from the center opening 42. As is understood from FIG. 11, due to presence of the ball holding sheet 44, the ball 7 is stably held by the tee member 10 while being lifted.

In the following, advantages of the present invention will be described.

First, due to the unique arrangement described hereinabove, the height of the ball teeing up device can be reduced to a degree corresponding to the length of the tee member 10. That is, the ball teeing up device of the invention is very thin as compared with the above-mentioned prior art devices. Usage of the outer cylinder 17, the inner cylinder 19, and the piston 22, which are telescopically connected, promotes the thinner construction of the ball teeing up device. In fact, the inventor has succeeded in reducing the thickness (viz., the length between the base and upper plates 1 and 2) of the device to about 100 mm with usage of a 62 mm-length tee member 10.

Second, the degree by which the tee member 10 is finally projected from the upper plate 2 can be easily adjusted by controlling the operation time of the step motor 34. This is very convenient to a trainee who is training golf with usage of various types of clubs.

Third, even when the tee member 10 assumes its uppermost position as shown in FIG. 7, the piston 22 on which the tee member 10 stands is tightly supported by the outer cylinder 17 through the inner cylinder 19. As is seen from the drawing, sufficiently large contact area is obtained not only between the piston 22 and the inner cylinder 19 but also between the inner cylinder 19 and the outer cylinder 17.

Fourth, due to usage of various sensors and the control circuit, the series of actions for teeing up the balls 7 one after another can be automatically carried out, which promotes the training effect of the trainee.

What is claimed is:

1. An automatic golf ball teeing up device comprising:

an upper plate having a ball-passing opening formed therethrough;

a ball receiving box located below said ball-passing opening;

means for feeding golf balls into the ball receiving box one after another;

a ball push-up mechanism including a ball push-up member movable in parallel with a major surface of said upper plate to pickup the ball in the box and push up the ball to a given upper position and a tee member, which moves with said ball push-up member, for supporting the ball once the ball push-up member pushes up the ball to said given upper position and positions said tee member below said ball-passing opening;

a lift mechanism for lifting said tee member together with the ball through said ball-passing opening to a predetermined height once the ball is placed onto the tee member positioned in said box; and a drive mechanism, including a moving plate and a single drive means, which moves said moving plate in a given direction, for successively actuating said ball push-up mechanism and said lift mechanism.

2. An automatic golf ball teeing up device as claimed in claim 1, wherein said ball-push up member is formed with an inclined upper surface extending from a pointed leading end of the ball push-up member to a highest trailing end of the same, said pointed leading end being directed to a lower portion of the ball in the box, said tee member being connected adjacent to the highest trailing end of said ball push-up member.

3. An automatic golf ball teeing up device as claimed in claim 1, wherein said lift mechanism comprises:

outer and inner cylinders, which are telescopically movably connected and respectively formed with mutually mated first and second vertically extending slots, said outer cylinder being secured to a fixed member;

piston slidably received in said inner cylinder, said piston supporting thereon said tee member; and a pin extending from said piston to the outside of said outer cylinder through said second and first slots, wherein said pin is moved vertically by said drive mechanism, and the positional relationship between the outer cylinder, the inner cylinder, and the piston is changed upon said pin being moved vertically.

4. An automatic golf ball teeing up device as claimed in claim 3, wherein said moving plate is movable in parallel with said ball push-up member and has a diagonal slot with which said pin is slidably engaged, said drive mechanism further comprising:

a wall defined by said box, said wall being formed with an L-shaped slit with which said pin is slidably engaged, said slit including a vertical part which, extends in parallel with the common axis of the outer and inner cylinders, and a horizontal part, which extends in parallel with the direction in which said ball push-up member moves.

5. An automatic golf ball teeing up device, comprising:

an upper plate having a ball-passing opening formed therethrough;

a ball receiving box located below said ball passing-opening;

first means for feeding golf balls into the ball receiving box one after another;

a ball push-up member movable in parallel with a major surface of said upper plate for picking up the ball in the box and pushing up the ball to a given upper position in said box;

a tee member, which moves with said ball push-up member, for supporting the ball once said ball push-up member pushes the ball to said given upper position and positions said tee member below said ball-passing opening;

a lift mechanism for lifting up said tee member together with the ball through said ball-passing opening to a predetermined height once the ball is placed onto the tee member a drive mechanism including a moving plate and a single drive means for moving said moving plate in a given direction for successively actuating said ball push-up member, said tee member, and then said lift mechanism; and second means for lowering the lift mechanism to lower said tee member to the interior of said box when the ball is not supported on said tee member.

6. An automatic golf ball teeing up device as claimed in claim 5, wherein said ball push-up member is formed with an inclined upper surface extending from a pointed leading end of the ball push-up member to a highest trailing end of the same, said pointed leading end being directed to a lower portion of the ball in the box.

7. An automatic golf ball teeing up device as claimed in claim 6, wherein said tee member is connected adjacent to the highest trailing end of said ball push-up member.

8. An automatic golf ball teeing up device as claimed in claim 5, wherein said lift mechanism comprises:

an outer cylinder having a vertically extending first slot;

an inner cylinder slidably received in said outer cylinder, said inner cylinder having a vertically extending second slot, which mates with said first slot;

a piston slidably received in said inner cylinder, said piston supporting thereon said tee member; and a pin connected to said piston to move therewith and extending to the outside of said outer cylinder through said second and first slots;

wherein said moving plate is movable in parallel with said ball push-up member, said moving plate having a diagonal slot with which said pin is slidably engaged.

9. An automatic golf ball teeing up device as claimed in claim 5, further comprising a movement control structure for moving said ball push-up member toward said box in said given direction until said tee member is positioned below said ball-passing opening.

10. An automatic golf ball teeing up device as claimed in claim 9, wherein said movement control structure comprises:

a wall defined by said box, said wall being formed with an L-shaped slit, which includes a vertical part and a horizontal part, said L-shaped slit being slidably engaged with said pin.

11. An automatic golf ball teeing up device as claimed in claim 8, wherein said drive means comprises:

a step motor;

a drive pulley connected to an output shaft of said step motor;

a driven pulley;

an endless belt operatively extending between said drive and driven pulleys; and a connecting plate for connecting said moving plate with a portion of said endless belt.

12. An automatic golf ball teeing up device as claimed in claim 5, wherein said first means comprises a ball guide tube connected to an opening of a side wall of said box, said guide tube being inclined for conveying the balls into the box by using gravity.

13. An automatic golf ball teeing up device as claimed in claim 5, wherein said second means comprises a sensor for detecting presence of the ball on said tee member.

14. An automatic golf ball teeing up device as claimed in claim 13, wherein said sensor comprises one of a photocell type, a piezoelectric type, or a sensor unit having a magnet and a Hall element.

15. An automatic golf ball teeing up device as claimed in claim 5, further comprising a ball-holding circular sheet fixed to said upper plate covering said ball-passing opening, said ball-holding sheet being formed with a circular center opening, which is smaller in diameter than the ball, and a plurality of slits extending radially outwardly from the center opening.

16. An automatic golf ball teeing up device as claimed in claim 8, further comprising:

a sleeve slidably disposed between said inner cylinder and said piston, said sleeve having said pin secured thereto;

means defining in said piston, a horizontal slot through which said pin passes, said horizontal slot being sized to permit the pin to move up and down therein;

a magnet secured to said piston at a position just below the pin; and a Hall element secured to said pin, said Hall element being associated with said magnet to constitute a sensor means for detecting presence of the ball on said tee member.

17. An automatic golf ball teeing up device as claimed in claim 5, wherein said moving plate is movable in parallel with said ball push-up member and has a diagonal slot with which said pin is slidably engaged, said drive mechanism further comprising:

a wall defined by said box, said wall being formed with an L-shaped slit with which said pin is slidably engaged, said slit including a vertical part, which extends in parallel with the common axis of said outer and inner cylinders, and a horizontal part, which extends in parallel with the direction in which said ball push-up member moves.

18. An automatic golf ball teeing up device, comprising:

an upper plate having a ball-passing opening formed therethrough;

a ball receiving box located below the ball-passing opening;

means for feeding golf balls into the ball receiving box one after another;

a ball push-up member including a ball push-up member movable in parallel with a major surface of the upper plate into the box to move the ball in the box to a given upper position, and a tee member, which moves with the ball push-up member, for supporting the ball once the ball push-up member moves the ball to the given upper position and positions the tee member below the ball-passing opening;

a lift mechanism for lifting up the tee member together with the ball to a predetermined height through the ball-passing opening once the ball is placed onto the tee member; and a drive mechanism for successively actuating the ball push-up mechanism and the lift mechanism, wherein the lift mechanism comprises:

outer and inner cylinders, which are telescopically movably connected and respectively formed with mutually mated first and second vertically extending slots, the outer cylinder being secured to a fixed member;

a piston slidably received in the inner cylinder, the piston supporting thereon the tee member; and a pin member extending from the piston to the outside of the outer cylinder through the second and first slots.

* * * * *